US005807149A

United States Patent [19]

Kaye

[11] Patent Number: 5,807,149

[45] Date of Patent: Sep. 15, 1998

[54] AIRBOAT SYSTEMS AND METHODS FOR INCREASING ENGINE EFFICIENCY WHILE REDUCING TORQUE AND NOISE

[75] Inventor: Bruce Kaye, Inverness, Fla.

[73] Assignee: K-Way Engineering, Inc., Cocoa, Fla.

[21] Appl. No.: 50,911

[22] Filed: Apr. 21, 1993

[51] Int. Cl.[6] ..... B63H 7/02

[52] U.S. Cl. ..... 440/37; 244/60; 244/69

[58] Field of Search ..... 244/105, 106, 244/69, 55, 23 R; 440/37, 75, 83, 84, 86; 416/129

[56] References Cited

U.S. PATENT DOCUMENTS

| | | | |
|---|---|---|---|
| 1,329,387 | 2/1920 | Fay | 440/37 |
| 1,734,268 | 11/1929 | Moorhouse . | |
| 1,842,055 | 1/1932 | Stout | 244/55 |
| 2,244,763 | 6/1941 | Bugatti | 244/55 |
| 2,380,952 | 8/1945 | Dewey . | |
| 2,525,708 | 10/1950 | Morris | 416/129 |
| 2,531,032 | 11/1950 | Desmoulins | 416/129 |
| 2,584,115 | 2/1952 | Dinsmoor | 416/129 |
| 3,500,784 | 3/1970 | Reynolds | 444/37 |
| 3,991,629 | 11/1976 | Dearnley . | |
| 4,127,080 | 11/1978 | Lakiza et al. . | |
| 4,392,839 | 7/1983 | Aucktor . | |
| 4,421,489 | 12/1983 | Van Veldhuizen | 440/37 |
| 4,426,049 | 1/1984 | Stewart | 244/69 |
| 4,527,978 | 7/1985 | Zackrisson . | |
| 4,820,241 | 4/1989 | Nakamura . | |
| 4,932,280 | 6/1990 | Becker et al. . | |
| 5,090,869 | 2/1992 | Wright | 416/129 |

FOREIGN PATENT DOCUMENTS

| | | | |
|---|---|---|---|
| 62131 | 11/1913 | Germany | 440/37 |

*Primary Examiner*—Galen L. Barefoot

*Attorney, Agent, or Firm*—Allen, Dyer, Doppelt, Milbrath & Gilcrhist, P.A.

[57] ABSTRACT

An airboat propelling system is provided wherein a propeller is rotated by a hollow driven shaft. A further embodiment is provided wherein two propellers are rotated in opposite directions by counter-rotating coaxial hollow driven shafts. Floating stiffener bearings positioned between the coaxial hollow driven shafts suppress flexion and protect the opposing surfaces of the shafts. These innovative techniques permit a minimization of size and weight, as well as a reduction in rotational speed of the propellers, maximizing efficiency and decreasing noise.

20 Claims, 8 Drawing Sheets

AIRBOAT SYSTEMS AND METHODS FOR INCREASING ENGINE EFFICIENCY WHILE REDUCING TORQUE AND NOISE

FIELD OF THE INVENTION

This invention generally relates to airboat systems and, particularly, to airboat propelling systems and methods for increasing efficiency while reducing torque and noise.

BACKGROUND OF THE INVENTION

Airboats are often driven over land and water at high speeds. Airboats typically employ aircraft engines operating at approximately 2500–3000 revolutions per minute (rpm) connected to solid direct-drive shafts, which rotate a single propeller. The steering apparatus usually comprises a pair of rudders, with trim tabs added to correct for the torque that results from the rotation of the propeller, this torque tending to keep the boat from maintaining a level attitude.

Extreme gyroscopic forces can occur when airboats are turned rapidly, and these forces are borne, among other structures, by the driven shaft.

Current airboat systems utilize belt-driven transmissions, which are inefficient owing to power losses caused by belt friction, especially at higher rotational velocities. Belt breakage in these systems is a source of failure. Another disadvantage of belt-driven systems is their inability to permit reduction of engine speed, since the shaft used to effect such a reduction would have to be too small to be practicable. Thus it would be advantageous to utilize a different transmission method in an airboat to enable engine speed reduction without loss of efficiency.

Propeller breakage is also a major source of failure, since at 3000 rpm extremely high forces are experienced at the propeller hub. It would therefore be desirable to reduce the load on the propeller.

It has been taught by Becker et al. (U.S. Pat. No. 4,932,280, dated Jun. 12, 1990) to use coaxial drive shaft systems for driving multiple outputs from a single input in an aircraft. Gearing means are disclosed for driving two outputs at different speeds.

A further concern in the airboat industry is noise pollution. Were it possible to increase efficiency and operate at reduced propeller speed, noise would be decreased.

SUMMARY OF THE INVENTION

One object of the invention is to provide an airboat having a hollow driven shaft of selected characteristics rotating a single propeller, in order to introduce a predetermined flexure into the system and avoid damage which might result from sharp turning movements. This shaft offers flexibility, strength, and decreased weight.

Another object of the invention is to provide a dual propeller system in an airboat with the propellers rotating in opposite directions and driven by coaxial shafts. This arrangement has many advantages, among which are:

(a) Noise reduction, since each propeller can turn at a significantly lower rotational rate to achieve the same speed as a single-propeller system;

(b) Elimination of torque, allowing the airboat to ride flat, since the counter-rotation of the two propellers yields a zero net angular force on the airboat;

(c) Increased efficiency, since the trim tabs on the rudders, which decrease thrust, can be eliminated, and since the distal propeller catches air turbulence "swirls" created by the proximal propeller and converts them to useful forward thrust; and (d) Increased durability and safety, since propeller breakage is greatly reduced, owing to the forces borne by them being cut in half.

A further object of the invention is to provide a transmission system necessary to drive the counter-rotating propellers. In the preferred form, two helical gear trains drive a pair of coaxial hollow driven shafts in opposite directions. A further improvement entails placing cylindrical floating stiffener bearings between the coaxial shafts to reduce whip in the shafts and to protect the opposing surfaces of the shafts. The further advantages gained by this combination of counter-rotator, coaxial hollow driven shafts and gear train are:

(e) Increased efficiency, since gear systems lose less to friction than do belt-driven units, and since weight is minimized by the optimization of the materials used in the construction of the shafts; and (f) Improved emissions properties, since the disclosed gear train unit permits the use of automotive engines, which have better overall performance, instead of the aircraft engines currently in use.

Another objective of the invention is to provide a lubricating system for the counter-rotator and coaxial shafts that enables smooth operation and increased durability. This lubrication system utilizes the longitudinal bores of the driven shafts, as well as features in the floating stiffener bearings, as parts of the oil circulation path, and also permits continuous lubrication of the gear trains.

DETAILED DESCRIPTION OF THE PREFERRED EMBODIMENTS

The preferred embodiments of an airboat design will be discussed with reference to FIGS. 1–10.

Airboat with Single Propeller and Hollow Driven Shaft

The first embodiment to be discussed entails an airboat with a single propeller mounted to a hollow driven shaft, in order to introduce a predetermined degree of flex to the airboat drive system, thereby avoiding equipment damage during certain extreme operating conditions.

Figure 1:
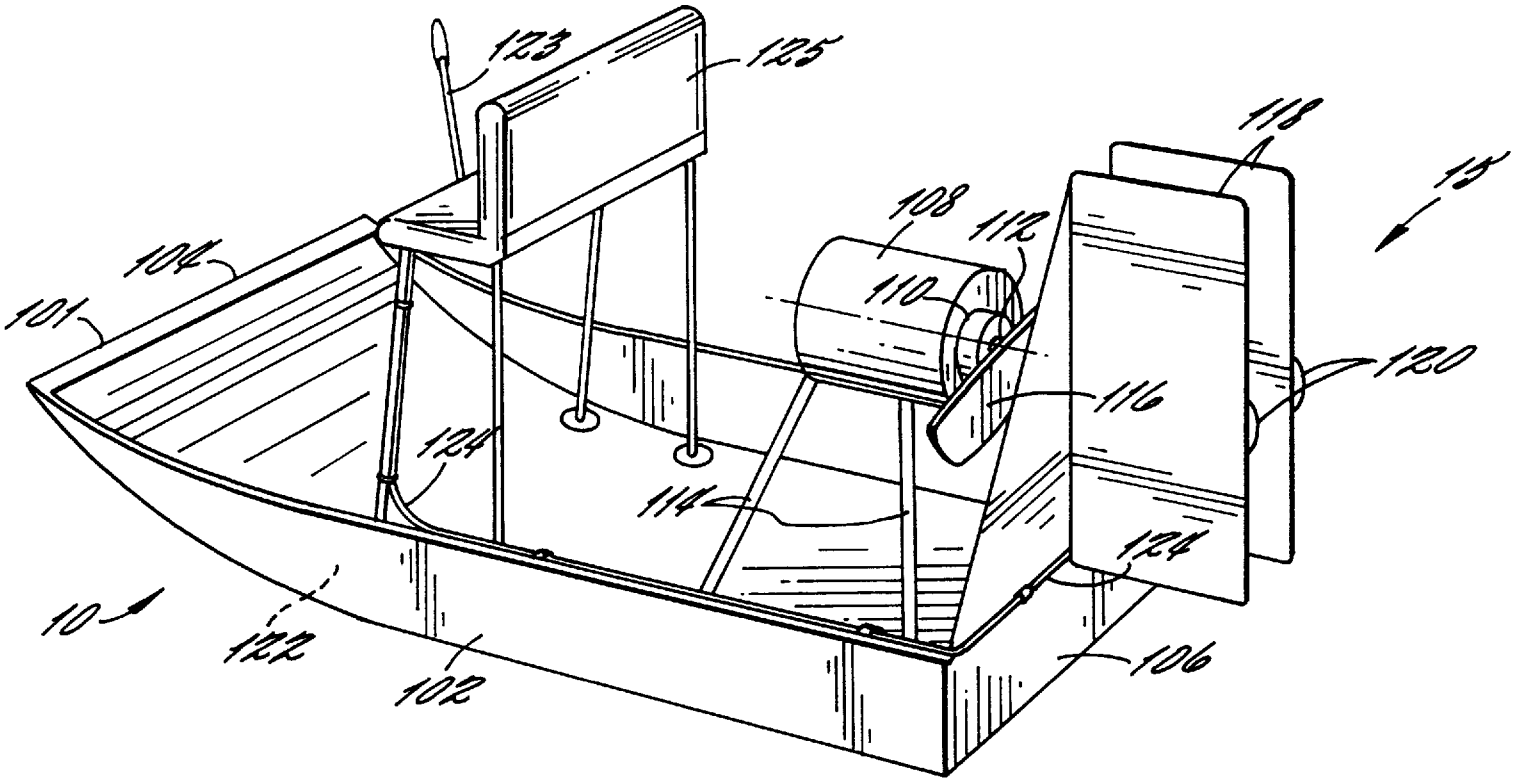
FIG. 1 is a schematic depiction of an airboat with a single propeller.

In FIG. 1 is shown an airboat 10 having a boat structure 104 with a bow 101, hull 122, gunwales 102, and stern 106. An engine 108 drives via transmission 110 a hollow driven shaft 112, upon which is mounted propeller 116. Typically, the engine 108 is an aircraft engine capable of operating at about 3000 rpm for sustained periods of time. Engine 108 is supported on mounting means 114, connected to the hull 122 of the boat structure 104. The mounting means 114 serve to raise engine 108, transmission 110, and hollow driven shaft 112 a sufficient distance that the propeller blade 116 clears the top of the stern 106; that is, the center of hollow driven shaft 112 must be positioned at least one-half the length of propeller blade 116 above the top of stern 106. Steering means 15 comprise rudders 118, trim tabs 120, which correct for torque caused by the turning of a single propeller blade, and steering manipulation means 124, operable from a joystick 123 at a forward position 125 remote from the steering means by an operator.

Figure 2:
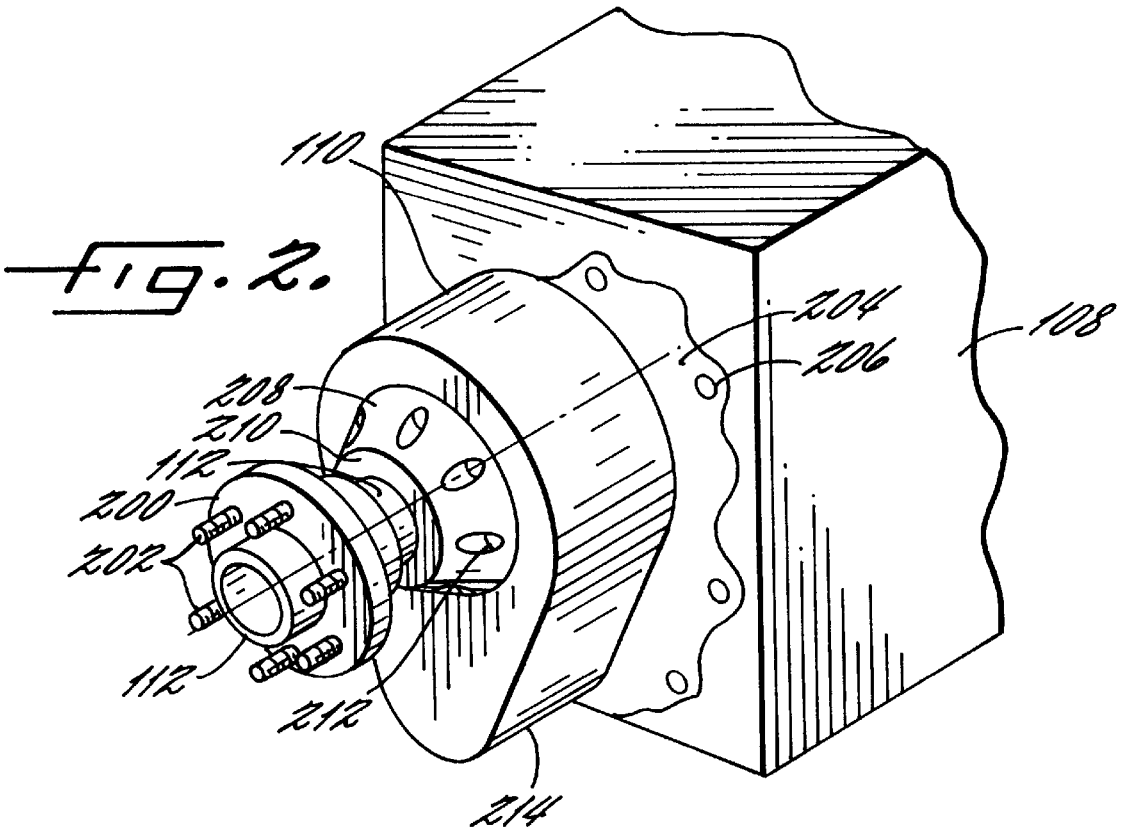
FIG. 2 is a perspective view of a transmission for an airboat with a single propeller, propeller mount, and hollow driven shaft.
Figure 2A:
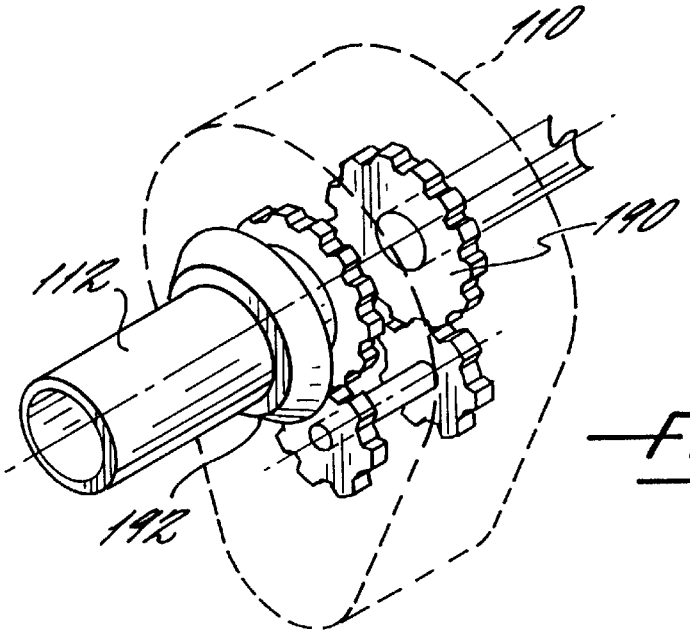
FIG. 2(a) illustrates the gear train and tapered bearings inside the transmission housing and output hub.

In FIG. 2 is shown the transmission 110 for an airboat with a single propeller. The transmission 110 is mounted to engine 108 by way of bell housing 204 via bolts 206. A gear train 190 in transmission 110 drives hollow driven shaft 112, to which is attached propeller mount 200, to whose protrusions 202, containing propeller dowels, a propeller is attached. Output hub 208 is attached to transmission housing 214 with bolts 212. Inside output hub 208 are tapered bearings 192 which provide an added flexibility to the hollow driven shaft 112 and allow lateral movement when turning forces are applied to the shaft 112. The tapered shape of output hub 208 permits optimal air flow to the propeller 116. Oil seal 210 is positioned between output hub 208 and shaft 112.

Typically, the hollow driven shaft 112 is on the order of 10.125 inches long and with the width at the proximal end, which is bolted to and driven by transmission 110, on the order of 3.0 inches. Following several shoulders in the outer surface of shaft 112, the outer diameter typically decreases to 2.25 inches at the distal end. A threaded portion on the outer surface of shaft 112 couples to the gear train inside transmission 110. At the position at which propeller mount 200 is attached, a key slot is situated, and the propeller mount 200 is affixed against a shoulder in the shaft (proximal to the propeller mount) having a diameter of 2.48 inches. The bore in shaft 112 typically tapers from about 1.88 inches at the proximal end to about 1.63 inches at the distal end.

The stress-strain properties of the steel used for the hollow driven shaft 112 and in the following two-shaft embodiment disclosed below with reference to FIGS. 3–9 are extremely important, owing to the flexibility required in airboat applications, as has been discussed. Therefore, a heat-treated and stress-relieved steel is preferred. By way of example, a tempered steel alloy denoted as 4150 28–30 RC is suitable.

The single-propeller embodiment discussed above thus provides a hollow driven shaft which offers flexibility and strength, improving operation lifetime owing to decreased failure rate, and decreased weight, improving efficiency. By way of example, a hollow driven shaft of the steel and dimensions noted above has been found to withstand a 180° turn at 45 MPH without catastrophic failure.

Airboat with Dual Propellers and Hollow Driven Shafts

The second embodiment to be discussed is an airboat containing a transmission with first and second gear trains, also called a counter-rotator, which drives coaxial proximal and distal propellers in opposite directions.

Figure 3:
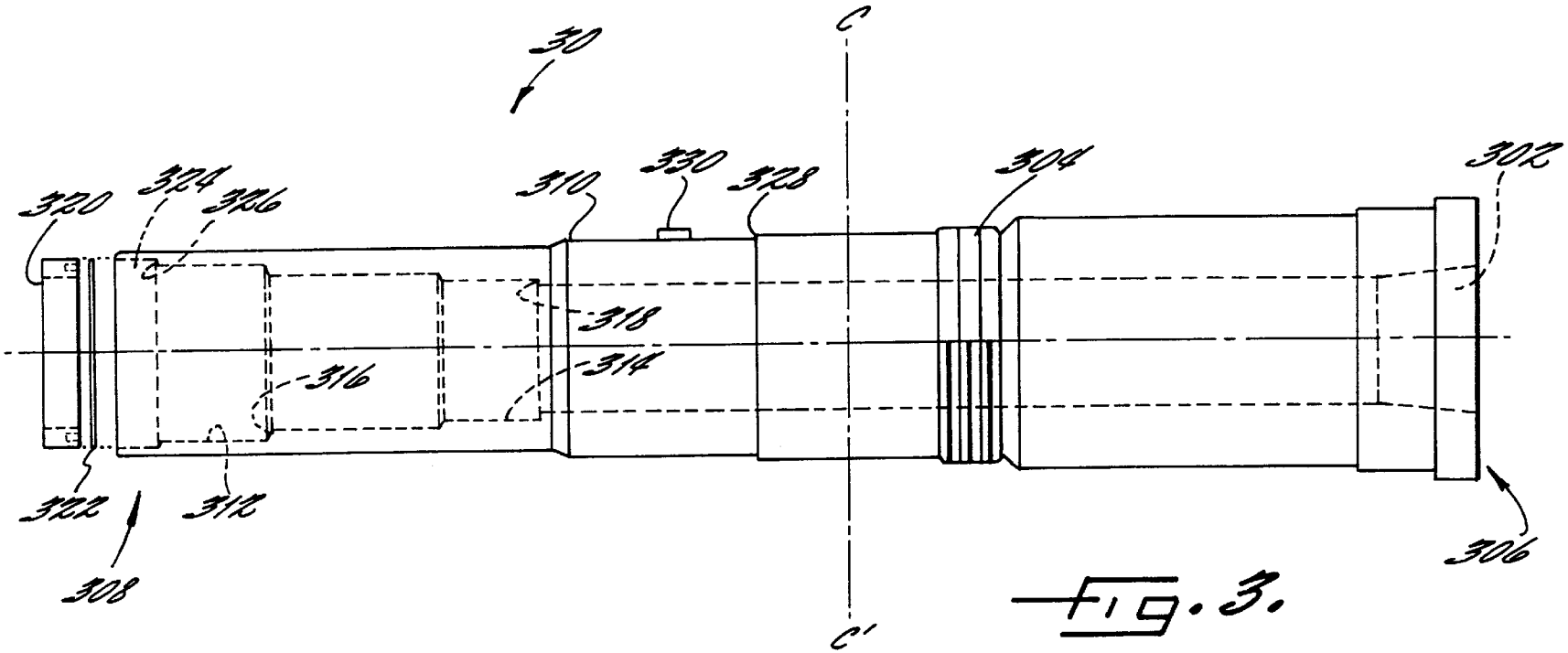
FIG. 3 is a side view of an outer hollow driven shaft useful in a coaxial drive system.
Figure 4:
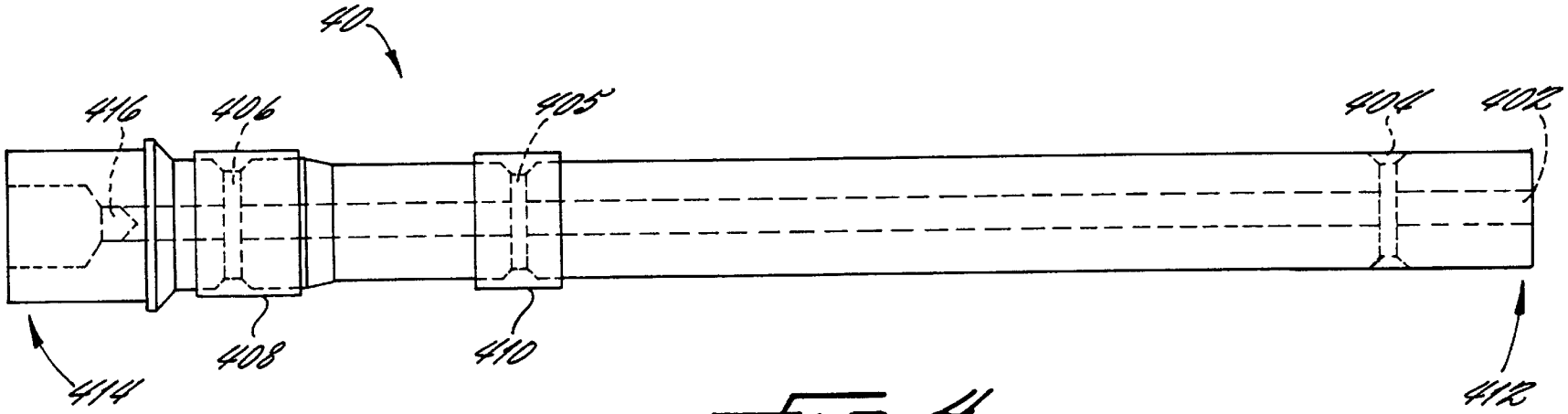
FIG. 4 is a side view of an inner hollow driven shaft useful in a coaxial drive system.
Figure 5:
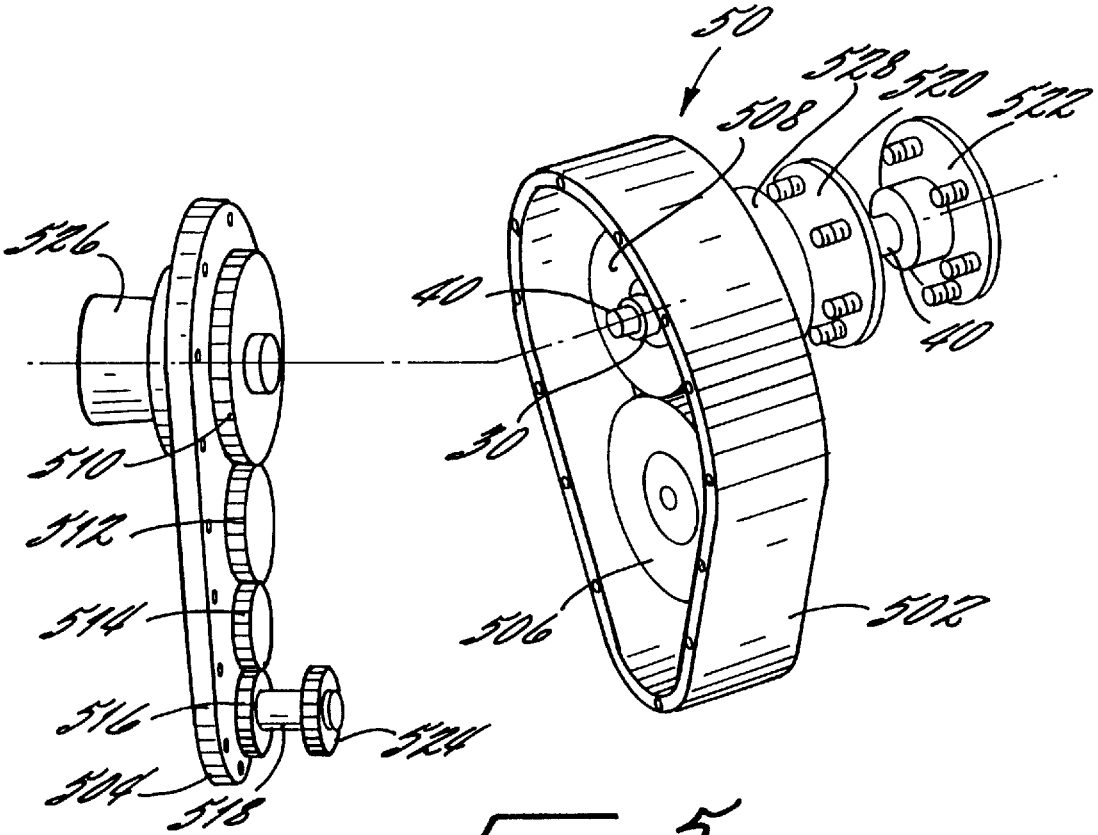
FIG. 5 is a perspective view of the interior of a transmission showing gear trains, the outer and inner hollow driven shafts of FIGS. 3 and 4, and both propeller mounts.
Figure 5A:
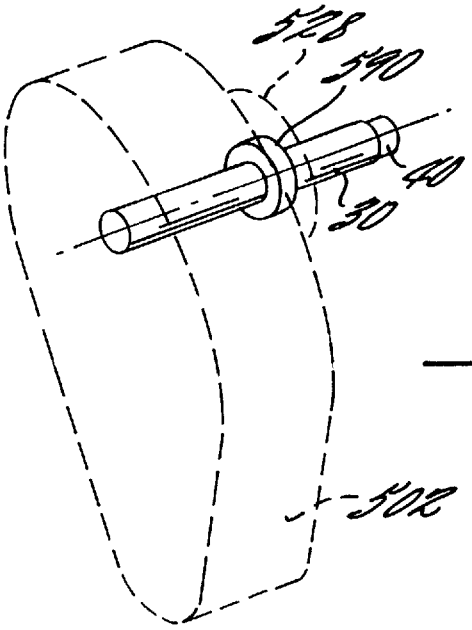
FIG. 5(a) illustrates the tapered bearings surrounding the driven shafts inside the output hub.

FIGS. 3–5 illustrate a first, outer hollow driven shaft 30 for use in an airboat having two propellers rotating in opposite directions. The first shaft 30 has a longitudinal bore 302 dimensioned to hold a second, longer hollow driven shaft 40 and stiffener bearings 408 and 410, which fit inside recesses 312 and 314, respectively, the bearings 408 and 410 positioned against the bore shoulders 316 and 318, respectively as shown in FIG. 5. Threaded portion 304 which connects the outer hollow driven shaft 30 at its proximal end 306 to the gearing means of the counter-rotator, as shown in FIG. 5. The position along shaft 30 at which the shaft enters the counter-rotator housing (502 on FIG. 5) is indicated by dotted line C–C' in FIG. 3. The propeller is affixed along straight portion 310 of the outer hollow driven shaft 30, against outer shoulder 328, with key 330, at which the shaft's diameter is on the order of 2.246 inches, in order to fit inside a standard propeller mount, whose inner diameter is almost universally a dimension of 2.25 inches. Seal 320 and washer 322 are affixed into the distal end 308 of outer shaft 30, into recess 324 against bore shoulder 326.

FIG. 4 illustrates the second, inner hollow driven shaft 40 having longitudinal bore 402, and a proximal end 412 with a spline for attachment to the gearing means in counter-rotator 50 (see FIG. 5). Circumferential holes 404, 405, and 406 in the second shaft 40 serve as part of the lubrication path, shown in more detail in FIG. 7. Floating stiffener bearings 408 and 410, shown in more detail in FIGS. 8 and 9, suppress flexion of the shafts 30, 40 and protect the inner surface of outer hollow driven shaft 30 from damage caused by abrasion from flexion of inner hollow driven shaft 40. At distal end 414 of inner shaft 40 is inserted plug 416 to block oil flow from bore 402 (see FIG. 7).

FIG. 5 shows the interior of the counter-rotator 50, including the gear trains. The exterior of counter-rotator 50 is formed by housing plate 504, secondary output hub 526, which contains an oil pump, counter-rotator housing body 502, and main output hub 528. As discussed for the single propeller system shown in FIG. 2, main output hub 528 contains bearings 590 separated by a spacer for added flexibility. The hub 528 permits the shafts to be supported at a greater distance from housing, as shown by line C–C' in FIG. 3. Also shown are the propeller mount 522, attached to inner hollow driven shaft 40, and propeller mount 520, attached to outer hollow driven shaft 30. The drive shaft from the engine is coupled to shaft 518, on which are gears 524 and 516. Gear 524 drives, in sequence, gears 506 and 508. Shaft 518 spaces off the first gear train, which drives outer hollow driven shaft 30, laterally from gear 516, which then drives a second gear train, comprising gears 514, 512, and 510. Gear 510 is coupled to inner driven shaft 40. The even number of direction-changing gears in the second gear train accomplishes counter-rotation from gear 516 to final gear 510; the odd number of direction-changing gears in the first gear train effects no change in initial direction from gear 524 to gear 508. Thus the hollow driven shafts 30 and 40 are rotated in opposite directions. It should be further noted that all gears, in the most preferred embodiment, in the first and second gear trains are helical gears, which ensures smoother, quieter action and better load capacity.

Figure 6:
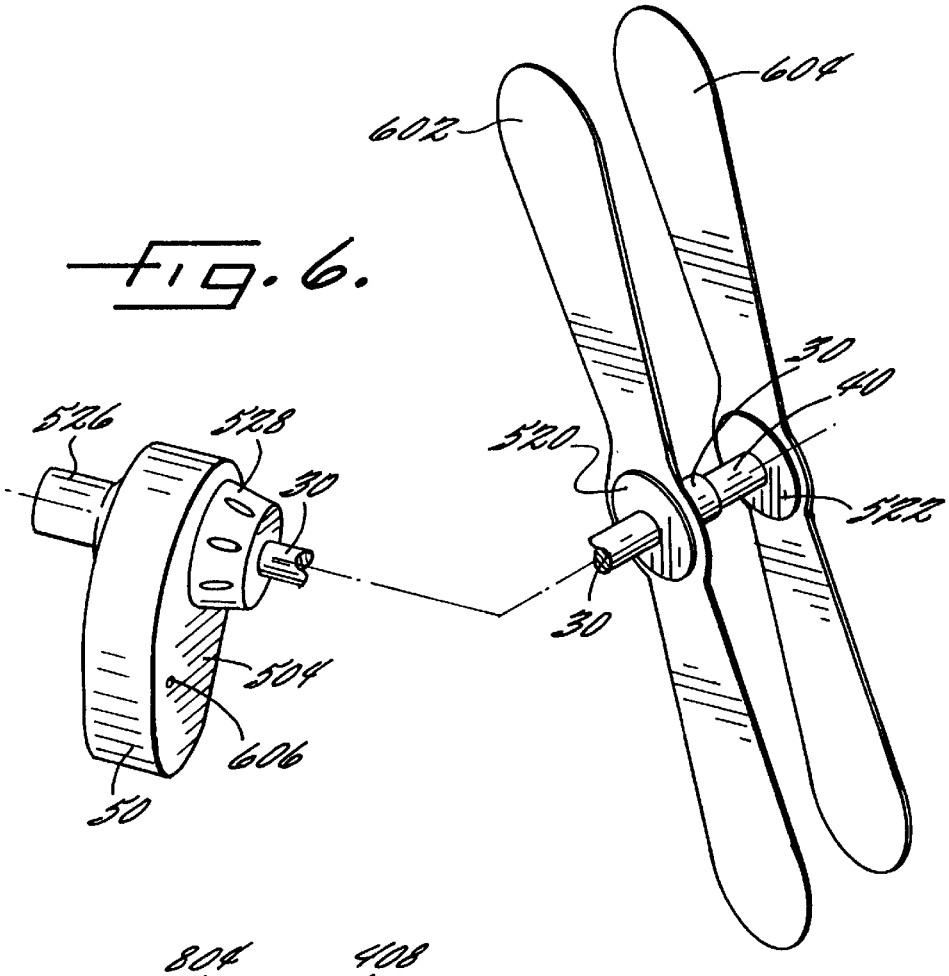
FIG. 6 shows a counter-rotator system for an airboat, using the transmission of FIG. 5 and the drive shafts of FIGS. 3 and 4.
Figure 10:
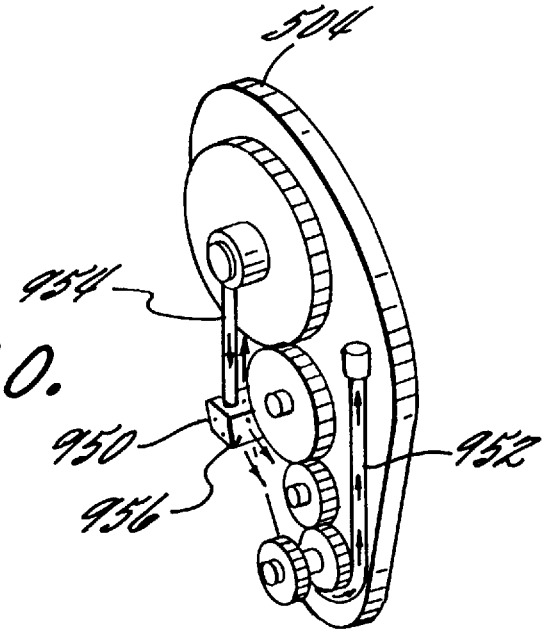
FIG. 10 is a perspective view of the transmission of FIG. 5, showing the path of lubricating oil.

FIG. 6 illustrates the combination of the counter-rotator 50 with outer hollow driven shaft 30, connected to propeller 602 via propeller mount 520, and with inner hollow driven shaft 40, connected to propeller 604 via propeller mount 522. Lubricating oil level is visualized through sight glass 606 in housing plate 504 in counter-rotator 50. (An illustration of the lubricating system within the counter-rotator is shown in FIG. 10.)

In a further embodiment, inner driven shaft 40 is driven 8–15% faster than outer driven shaft 30, which is accomplished by dimensioning the gears accordingly. This rotation difference increases the efficiency of the airboat system by permitting air turbulence "swirls" created by the proximal propeller 604 to be converted to useful forward thrust by propeller 602.

Figure 8:
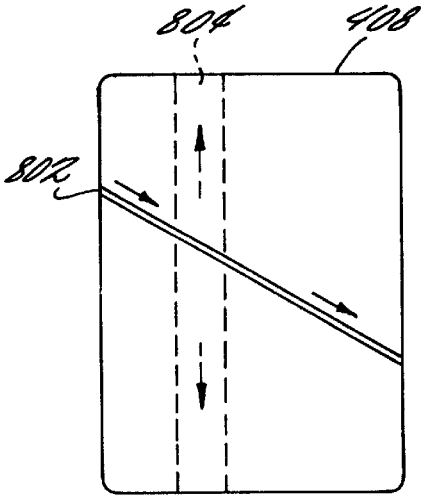
FIG. 8 is a side view of one of a first floating stiffener bearing of FIG. 7.
Figure 9:
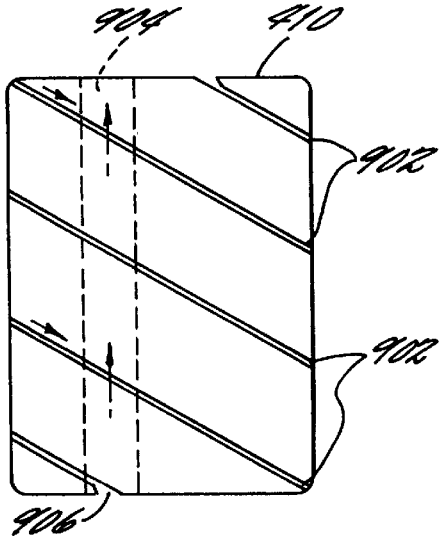
FIG. 9 is a side view of a second floating stiffener bearing of FIG. 7.
Figure 7:
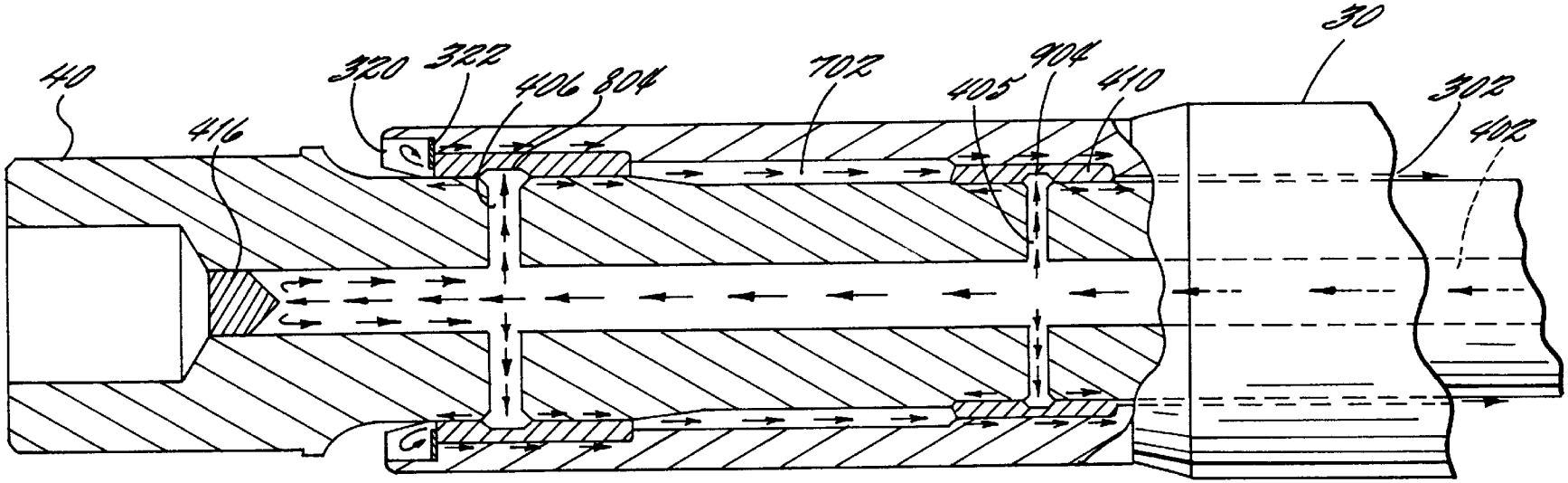
FIG. 7 is a cross-sectional view of the hollow driven shafts of FIGS. 3 and 4 with floating stiffener bearings, showing the path of lubricating oil by arrows.

FIG. 7 is a longitudinally cross-sectional view of the combined outer 30 and inner 40 hollow driven shafts and first floating stiffener bearing 408 and second floating stiffener bearing 410. FIGS. 8 and 9 show details of the floating stiffener bearings 408 and 410, respectively, which are in the preferred embodiment made of bronze, in this example a bronze denoted as Aamco 660, a material chosen for its strength and flexibility. As is known in the art, bearing materials should be softer than the shaft materials, which is the case here. The assembly of these elements and the path of lubricating oil flow will be discussed with reference to FIGS. 7–9.

Inner hollow driven shaft 40 is inserted into the bore 302 of outer hollow driven shaft 30. Hollow cylindrical floating stiffener bearings 408 and 410 are positioned between the hollow driven shafts 30 and 40 as previously discussed. Further, inner circumferential grooves 804 and 904 in floating stiffener bearings 408 and 410 are situated to communicate with diametric holes 406 and 405, respectively, in the inner hollow driven shaft 40. First floating stiffener bearing 408 has two outer angled grooves 802, and second floating stiffener bearing 410 has seven outer angled grooves 902. These angled grooves are wider and deeper at the edges 906 to improve oil circulation properties. The second floating stiffener bearing 410 has a greater number of grooves than the first floating stiffener bearing 408, since it will be seen to be in the path of greater oil flow volume.

The lubrication of the shaft and bearing assembly will now be discussed. Oil pumping means provides lubricant, in the most preferred embodiment 80–90 weight multipurpose differential oil, at approximately 25 pounds per square inch pressure. Referring to the arrows in FIG. 7, oil enters through inner shaft bore 402, via diametric hole 404 (shown in FIG. 4), being stopped at plug 416 in bore 402. The two diametric holes 406 and 405 communicate with inner circumferential grooves 804 and 904 in floating stiffener bearings 408 and 410, respectively, wherefrom oil passes between the inner surfaces of the floating stiffener bearings 408 and 410 and the outer surface of inner shaft 40. The outer surfaces of floating stiffener bearings 408 and 410 are lubricated via angled grooves 802 and 902, respectively. The arrows in FIGS. 8 and 9 illustrate the oil flow path inside and outside the floating stiffener bearings 408 and 410. Oil escape from the distal end of outer shaft 30 is prevented by seal 320 and washer 322.

The path of returning oil flow proceeds between the inner surface of outer shaft 30 and the outer surfaces of floating stiffener bearing 408, floating stiffener bearing 410, and inner shaft 40.

The path of returning oil continues as shown in FIG. 10. Emerging from between hollow driven shafts 30 and 40, oil is collected in tube 954 and enters oil gallery block 950, which has pores 956. Through these pores 956 oil sprays onto the gear trains inside counter-rotator 50 and collects at the bottom of counter-rotator housing body 502, shown in FIG. 5. This collected oil is recirculated by being pumped out of counter-rotator housing body 502 through tube 952, back to the oil pumping means.

While the preceding discussion discloses the preferred embodiments of the present invention, it will be understood by those skilled in the art that other embodiments are possible.

What is claimed is:

1. An airboat, comprising:

a boat structure having a hull, bow, gunwales, and stern;

engine means;

means for mounting the engine means to the rearward end of the boat structure adjacent to the stern;

a hollow driven shaft, connected to and driven by the engine means; and a propeller, mounted to the distal end of the hollow driven shaft.

2. The airboat recited in claim 1, further comprising:

steering means, mounted on the hull rearward of the propeller, linked to and manipulable from a position remote from the position of the steering means;

gear means, driven by the engine means; and tapered bearing means; and wherein the hollow driven shaft is connected to and driven by the engine means through the gear means; and the tapered bearing means are positioned in supporting relation to the hollow driven shaft between the gear means and the propeller to permit flexion of the hollow driven shaft and to allow lateral movement when a torque is applied to the hollow driven shaft.

3. The airboat recited in claim 1, wherein the hollow driven shaft has an outside diameter on the order of 2.25 inches.

4. The airboat recited in claim 1, wherein the hollow driven shaft has an elongated hollow bore extending longitudinally through the shaft.

5. The airboat recited in claim 1, wherein the hollow driven shaft is sufficiently deflectable to withstand a 180° turn at 45 miles per hour without catastrophic failure.

6. An airboat, comprising:

a boat structure having a hull, bow, gunwales, and stern;

an outer hollow driven shaft;

an inner hollow driven shaft, dimensioned to fit into and extending through the outer hollow driven shaft, the distal end protruding beyond that of the outer hollow driven shaft;

engine means, including means for driving the outer and inner hollow driven shafts in opposite directions;

means for mounting the engine means adjacent to the stern;

a first propeller, connected to the distal end of the outer hollow driven shaft; and a second propeller, connected to the distal end of the inner hollow driven shaft.

7. The airboat recited in claim 6, wherein the engine means comprise:

an engine;

a drive shaft connected to the engine;

gear means comprising a first gear train for driving the outer hollow driven shaft and a second gear train for driving the inner hollow driven shaft, the first and the second gear trains connected to and driven by the drive shaft; and tapered bearing means positioned in supporting relation to the outer hollow driven shaft between the gear means and the first propeller to permit flexion of the outer hollow driven shaft and to allow lateral movement when a torque is applied to the outer hollow driven shaft.

8. Propelling means for an airboat, comprising:

an engine;

a drive shaft connected to the engine;

a transmission connected to the drive shaft, the transmission comprising a first gear train and a second gear train;

an outer hollow driven shaft having a longitudinal bore, connected to and driven by the first gear train of the transmission;

an inner hollow driven shaft having a longitudinal bore, connected to and driven by the second gear train of the transmission, dimensioned to fit into and extending through the outer hollow driven shaft;

a first propeller, connected to the distal end of the outer hollow driven shaft; and a second propeller, connected to the distal end of the inner hollow driven shaft; wherein the transmission and the inner and the outer hollow driven shaft are constructed and formed of material capable of withstanding 180 degree turns at 45 miles per hour without catastrophic failure.

9. The propelling means for an airboat recited in claim 8, the inner hollow driven shaft having diametric holes communicating with the long axis of the inner hollow driven shaft, positioned proximal to the distal end of the outer hollow driven shaft;

each hollow driven shaft having a sealing means at its distal end; and further comprising means for directing oil pressure inside the inner hollow driven shaft, out the diametric holes in the inner hollow driven shaft, between the outer surface of the inner hollow driven shaft and the inner surface of the outer hollow driven shaft, toward the proximal end of the hollow driven shafts, and inside the transmission.

10. The propelling means for an airboat recited in claim 9, further comprising:

cylindrical stiffener bearing means for suppressing flexion of the inner and the outer hollow driven shafts and for protecting the inner surface of the outer hollow driven shaft from damage caused by abrasion from flexion of the inner hollow driven shaft, the cylindrical stiffener bearing means each having an inner circumferential groove positioned over the diametric hole in the inner hollow driven shaft.

11. The propelling means for an airboat recited in claim 10, wherein the cylindrical stiffener bearing means further have a plurality of outer angled grooves, the angle being approximately −30° from the long axis of the cylindrical stiffener bearing means.

12. The propelling means recited in claim 8, further comprising:

a transmission housing affixed to the engine, surrounding the transmission;

an output hub, attached to the transmission housing and surrounding the inner and the outer hollow driven shafts; and tapered bearing means positioned in the output hub in supporting relation to the outer hollow driven shaft between the gear means and the first propeller to permit flexion of the outer hollow driven shaft and to allow lateral movement when a torque is applied to the outer hollow driven shaft.

13. The propelling means for an airboat recited in claim 11, further comprising:

a first tube for collecting oil emerging from between the inner and the outer hollow driven shafts;

an oil gallery block affixed adjacent the first and the second gear trains, the oil gallery block having means for receiving oil from the tube and further having pores for permitting the passage of oil therethrough from the receiving means onto the first and the second gear trains; and a second tube for collecting oil from the first and the second gear trains and transporting it to the means for directing oil pressure;

wherein the means for directing oil pressure further comprises means for directing oil pressure from the diametric holes in the inner hollow driven shaft into the inner circumferential groove in the cylindrical stiffener bearing means, into the outer angled grooves in the cylindrical stiffener bearing means, into the first tube, into the oil gallery block, into the second tube, and into the means for directing oil pressure.

14. Method for reducing noise caused by an airboat propeller system, comprising:

providing engine means, including means for driving two propellers in opposite directions;

extending an outer hollow driven shaft from the propeller driving means for one direction;

extending an inner hollow driven shaft from the propeller driving means for the other direction from that of the outer hollow driven shaft, the inner hollow driven shaft being dimensioned to fit into and extending through the outer hollow driven shaft, the distal end protruding beyond that of the outer hollow driven shaft;

providing a first propeller, connected to the distal end of the outer hollow driven shaft;

providing a second propeller, connected to the distal end of the inner hollow driven shaft; and driving the propellers at a rotational rate less than would be required for a single propeller to attain the same airboat speed.

15. Method for increasing the efficiency of an airboat propeller system, comprising:

providing engine means, including means for driving two propellers in opposite directions;

extending an outer hollow driven shaft from the propeller driving means for one direction;

extending an inner hollow driven shaft from the propeller driving means for the other direction from that of the outer hollow driven shaft, the inner hollow driven shaft being dimensioned to fit into and extending through the outer hollow driven shaft, the distal end protruding beyond that of the outer hollow driven shaft;

providing a first propeller, connected to the distal end of the outer hollow driven shaft;

providing a second propeller, connected to the distal end of the inner hollow driven shaft;

driving the first propeller at a rotational rate less than would be required for a single propeller to attain the same airboat speed, the first propeller creating air turbulence; and driving the second propeller at a speed 8–15% faster than that of the first propeller, the second propeller converting the air turbulence caused by the first propeller to useful forward thrust.

16. An airboat propulsion system comprising:

engine means;

a drive shaft driven by the engine means;

a transmission comprising:

a housing, mounted to the engine means; and a gear train, driven by the drive shaft;

a hollow driven shaft, driven by the gear train, the hollow driven shaft being formed of a material capable of withstanding 180 degree turns at 45 miles per hour without catastrophic failure;

an output hub, attached to the transmission housing and surrounding the hollow driven shaft;

a propeller, affixed to and driven by the hollow driven shaft; and tapered bearing means positioned within the output hub and surrounding the hollow driven shaft for permitting lateral movement of the hollow driven shaft when the hollow driven shaft experiences torque and thus for reducing torque experienced by the propeller.

17. The airboat propulsion system recited in claim 16, wherein the output hub is tapered to permit air flow to the propeller.

18. The airboat propulsion system recited in claim 16, wherein the material of which the hollow driven shaft is formed comprises a heat-treated, stress-relieved steel.

19. Method for creating an airboat propelling system, comprising:

providing engine means, including means for driving two propellers in opposite directions;

extending an outer hollow driven shaft from the propeller driving means for one direction;

extending an inner hollow driven shaft from the propeller driving means for the other direction from that of the outer hollow driven shaft, the inner hollow driven shaft being dimensioned to fit into and extending through the outer hollow driven shaft, the distal end protruding beyond that of the outer hollow driven shaft;

providing a first propeller, connected to the distal end of the outer hollow driven shaft;

providing a second propeller, connected to the distal end of the inner hollow driven shaft; and rotating the two hollow driven shafts in opposite directions.

20. Method for reducing torque on an airboat propelling system, comprising:

providing engine means, including means for driving two propellers in opposite directions;

extending an outer hollow driven shaft from the propeller driving means for one direction;

extending an inner hollow driven shaft from the propeller driving means for the other direction from that of the outer hollow driven shaft, the inner hollow driven shaft being dimensioned to fit into and extending through the outer hollow driven shaft, the distal end protruding beyond that of the outer hollow driven shaft;

providing a first propeller, connected to the distal end of the outer hollow driven shaft;

providing a second propeller, connected to the distal end of the inner hollow driven shaft; and rotating the two hollow driven shafts in opposite directions.

* * * * *